US005129970A

United States Patent [19]

Henry

[11] Patent Number: 5,129,970

[45] Date of Patent: Jul. 14, 1992

[54] METHOD OF FORMING FATIGUE CRACK RESISTANT NICKEL BASE SUPERALLOYS AND PRODUCT FORMED

[75] Inventor: Michael F. Henry, Schenectady, N.Y.

[73] Assignee: General Electric Company, Schenectady, N.Y.

[21] Appl. No.: 248,755

[22] Filed: Sep. 26, 1988

[51] Int. Cl.[5] ..... C22C 19/05

[52] U.S. Cl. ..... 148/428; 420/443; 420/448

[58] Field of Search ..... 420/448, 443; 148/428, 148/410

[56] References Cited

U.S. PATENT DOCUMENTS 3,061,426 10/1962 Bieber ..... 420/448

*Primary Examiner*—R. Dean

*Attorney, Agent, or Firm*—Paul E. Rochford; James C. Davis, Jr.; James Magee, Jr.

[57] ABSTRACT

The present invention provides an alloy having improved crack growth inhibition and having high strength at high temperatures. The composition of the alloy is essentially as follows:

| Ingredient | Concentration in Weight % |
|---|---|
| Ni | balance |
| Co | 15 |
| Cr | 10 |
| Mo | 3 |
| Al | 3.35 |
| Ti | 5.90 |
| Ta | 2.70 |
| Nb | 1.35 |
| Zr | 0.06 |
| V | 1 |
| C | 0.05 |
| B | 0.03. |

4 Claims, 9 Drawing Sheets

METHOD OF FORMING FATIGUE CRACK RESISTANT NICKEL BASE SUPERALLOYS AND PRODUCT FORMED

RELATED APPLICATIONS

The subject applications relates generally to the subject matter of application Ser. No. 907,550, filed Sept. 15, 1986 and Ser. No. 080,353, filed Jul. 31, 1987 which applications are assigned to the same assignee as the subject application herein. It also relates to Ser. Nos. 103,851, 103,996, and 104,001, filed Oct. 2, 1987; Ser. Nos. 248,754 and 248,756, filed Sept. 26, 1988; and Ser. No. 250,204, filed Sept. 28, 1988. The texts of the related application are incorporated herein by reference.

BACKGROUND OF THE INVENTION

It is well known that nickel based superalloys are extensively employed in high performance environments. Such alloys have been used extensively in jet engines, in land based gas turbines and other machinery where they must retain high strength and other desirable physical properties at elevated temperatures of 1000° F. or more.

Many of these alloys contain a $\gamma'$ precipitate in varying volume percentages. The $\gamma'$ precipitate contributes to the high performance properties of such alloys at their elevated use temperatures.

More detailed characteristics of the phase chemistry of $\gamma'$ are given in "Phase Chemistries in Precipitation-Strengthening Superalloy" by E. L. Hall, Y. M. Kouh, and K. M. Chang [Proceedings of 41st Annual Meeting of Electron Microscopy Society of America, Aug. 1983 (p. 248)].

The following U.S. Patents disclose various nickel-base alloy compositions: U.S. Pat. No. 2,570,193; U.S. Pat. No.2,621,122; U.S. Pat. No.3,046,108; U.S. Pat. No.3,061,426; U.S. Pat. No.3,151,981; U.S. Pat. No.3,166,412; U.S. Pat. No.3,322,534; U.S. Pat. No.3,343,950; U.S. Pat. No.3,575,734; U.S. Pat. No.3,576,861; U.S. Pat. No.4,207,098 and U.S. Pat. No.4,336,312. The aforementioned patents are representative of the many alloying developments reported to date in which many of the same elements are combined to achieve distinctly different functional relationships between the elements such that phases providing the alloy system with different physical and mechanical characteristics are formed. Nevertheless, despite the large amount of data available concerning the nickel-based alloys, it is still not possible for workers in the art to predict with any significant degree of accuracy the physical and mechanical properties that will be displayed by certain concentrations of known elements used in combination to form such alloys even though such combination may fall within broad, generalized teachings in the art, particularly when the alloys are processed using heat treatments different from those previously employed.

A problem which has been recognized to a greater and greater degree with many such nickel based superalloys is that they are subject to formation of cracks or incipient cracks, either in fabrication or in use, and that the cracks can actually propagate or grow while under stress as during use of the alloys in such structures as gas turbines and jet engines. The propagation or enlargement of cracks can lead to part fracture or other failure. The consequence of the failure of the moving mechanical part due to crack formation and propagation is well understood. In jet engines it can be particularly hazardous.

U.S. Pat. No. 4,685,977, entitled "Fatigue-Resistant Nickel-Base Superalloys and Method" is assigned to the same assignee as the subject application. It discloses an alloy having a superior resistance to fatigue crack propagation based on alloy chemistry, $\gamma'$ precipitate content and grain structure. A method of alloy preparation is also taught.

However, what has been poorly understood until recent studies were conducted was that the formation and the propagation of cracks in structures formed of superalloys is not a monolithic phenomena in which all cracks are formed and propagated by the same mechanism and at the same rate and according to the same criteria. By contrast the complexity of the crack generation and propagation and of the crack phenomena generally and the interdependence of such propagation with the manner in which stress is applied is a subject on which important new information has been gathered in recent years. The variability from alloy to alloy of the effect of the period during which stress is applied to a member to develop or propagate a crack, the intensity of the stress applied, the rate of application and of removal of stress to and from the member and the schedule of this application was not well understood in the industry until a study was conducted under contract to the National Aeronautics and Space Administration. This study is reported in a technical report identified as NASA CR-165123 issued from the National Aeronautics and Space Administration, NASA Lewis Research Center, Contract NAS3-21379.

A principal finding of the NASA sponsored study was that the rate of propagation based on fatigue phenomena or in other words, the rate of fatigue crack propagation (FCP), was not uniform for all stresses applied nor to all manners of applications of stress. More importantly, the finding was that fatigue crack propagation actually varied with the frequency of the application of stress to the member where the stress was applied in a manner to enlarge the crack. More surprising still, was the magnitude of the finding from the NASA sponsored study that the application of stress of lower frequencies rather than at the higher frequencies previously employed in studies, actually increased the rate of crack propagation. In other words, the NASA study verified that there was a time dependence in fatigue crack propagation. Further, the time dependence of fatigue crack propagation was found to depend not on frequency alone but on the time during which the member was held under stress or a so-called hold-time.

Following the documentation of this unusual degree of increased fatigue crack propagation at lower stress frequencies there was some belief in the industry that this newly discovered phenomena represented an ultimate limitation on the ability of the nickel based superalloys to be employed in the stress bearing parts of the turbines and aircraft engines and that all design effort had to be made to design around this problem.

However, it has been discovered that it is feasible to construct parts of nickel based superalloys for use at high stress in turbines and aircraft engines with greatly reduced crack propagation rates and with good high temperature strength.

It is known that the most demanding sets of properties for superalloys are those which are needed in connection with jet engine construction. Of the sets of properties which are needed those which are needed for the moving parts of the engine are usually greater than those needed for static parts, although the sets of needed properties are different for the different components of an engine.

Because some sets of properties are not attainable in cast alloy materials, resort is sometimes had to the preparation of parts by powder metallurgy techniques. However, one of the limitations which attends the use of powder metallurgy techniques in preparing moving parts for jet engines is that of the purity of the powder. If the powder contains impurities such as a speck of ceramic or oxide the place where that speck occurs in the moving part becomes a latent weak spot where a crack may initiate. Such a weak spot is in essence a latent crack. The possible presence of such latent cracks makes the problems of reducing and inhibiting the crack propagation rate all the more important. I have found that it is possible to inhibit crack propagation both by the control of the composition of alloys and by the methods of preparation of such metal alloys.

Pursuant to the present invention, a superalloy which can be prepared by powder metallurgy techniques is provided. Also, a method for processing this superalloy to produce materials with a superior set of combination of properties for use in advanced engine disk application is provided. The properties which are conventionally needed for materials used in disk applications include high tensile strength and high stress rupture strength. In addition, the alloy of the subject invention exhibits a desirable property of resisting time dependent crack growth propagation. Such ability to resist crack growth is essential for the component low cycle fatigue (LCF) life.

As alloy products for use in turbines and jet engines have developed it has become apparent that different sets of properties are needed for parts which are employed in different parts of the engine or turbine. For jet engines the material requirements of more advanced aircraft engines continue to become more strict as the performance requirements of the aircraft engines are increased. The different requirements are evidenced, for example, by the fact that many blade alloys display very good high temperature properties in the cast form. However, the direct conversion of cast blade alloys into disk alloys is very unlikely because blade alloys display inadequate strength at intermediate temperatures. Further, the blade alloys have been found very difficult to forge and forging has been found desirable in the fabrication of disks from disk alloys. Moreover, the crack growth resistance of disk alloys has not been evaluated. Accordingly, to achieve increased engine efficiency and greater performance constant demands are made for improvements in the strength and temperature capability of disk alloys as a special group of alloys for use in aircraft engines.

Accordingly, what was sought in undertaking the work which lead to the present invention was the development of a disk alloy having a low or minimum time dependence of fatigue crack propagation and moreover a high resistance to fatigue cracking. In addition what was sought was a balance of properties and particularly of tensile, creep and fatigue properties. Further, what was sought was an enhancement of established alloy systems relative to inhibition of crack growth phenomena.

The development of the superalloy compositions and methods of their processing of this invention focuses on the fatigue property and addresses in particular the time dependence of crack growth.

Crack growth, i.e., the crack propagation rate, in high-strength alloy bodies is known to depend upon the applied stress ($\alpha$) as well as the crack length (a). These two factors are combined by fracture mechanics to form one single crack growth driving force; namely, stress intensity factor K, which is proportional to $\alpha\sqrt{a}$. Under the fatigue condition, the stress intensity in a fatigue cycle may consist of two components, cyclic and static. The former represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is material dependent. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys. To add to the complexity of this time-dependence phenomenon, when the temperature is increased above some point, the crack can grow under static stress of some intensity K without any cyclic component being applied (i.e. $\Delta K=0$). The design objective is to make the value of da/dN as small and as free of time-dependency as possible. Components of stress intensity can interact with each other in some temperature range such that crack growth becomes a function of both cyclic and static stress intensities, i.e., both $\Delta K$ and K.

BRIEF DESCRIPTION OF THE INVENTION

It is, accordingly, one object of the present invention to provide nickel-base superalloy products which are more resistant to cracking.

Another object is to provide a method for reducing the tendency of known and established nickel-base super-alloys to undergo cracking.

Another object is to provide articles for use under cyclic high stress which are more resistant to fatigue crack propagation.

Another object is to provide a composition and method which permits nickel-base superalloys to have imparted thereto resistance to cracking under stress which is applied cyclically over a range of frequencies.

Another object is to provide an alloy which is resistant to fatigue crack propagation at elevated temperatures of 1200° F., 1400° F. and at higher temperatures.

Other objects will be in part apparent and in part pointed out in the description which follows.

In one of its broader aspects, objects of the invention can be achieved by providing a composition of the following approximate content:

| Ingredient | Concentration in weight % Claimed Composition From | To |
|---|---|---|
| Ni | balance | |
| Co | 12 | 18 |
| Cr | 7 | 13 |
| Mo | 2 | 4 |
| W | 0 | 1.0 |
| Al | 2.0 | 5.0 |
| Ti | 5.0 | 7.0 |

-continued

| Ingredient | Concentration in weight % Claimed Composition From | To |
|---|---|---|
| Ta | 2.0 | 3.2 |
| Nb | 1.0 | 1.7 |
| Hf | 0 | 0.75 |
| Zr | 0 | 0.1 |
| V | 0.0 | 2.0 |
| C | 0.0 | 0.2 |
| B | 0.0 | 0.10 |
| Re | 0 | 1 |
| Y | 0 | 0.10 |

BRIEF DESCRIPTION OF THE DRAWINGS

In the description which follows clarity of understanding will be gained by reference to the accompanying drawings in which.

DETAILED DESCRIPTION OF THE INVENTION

Figure 1:
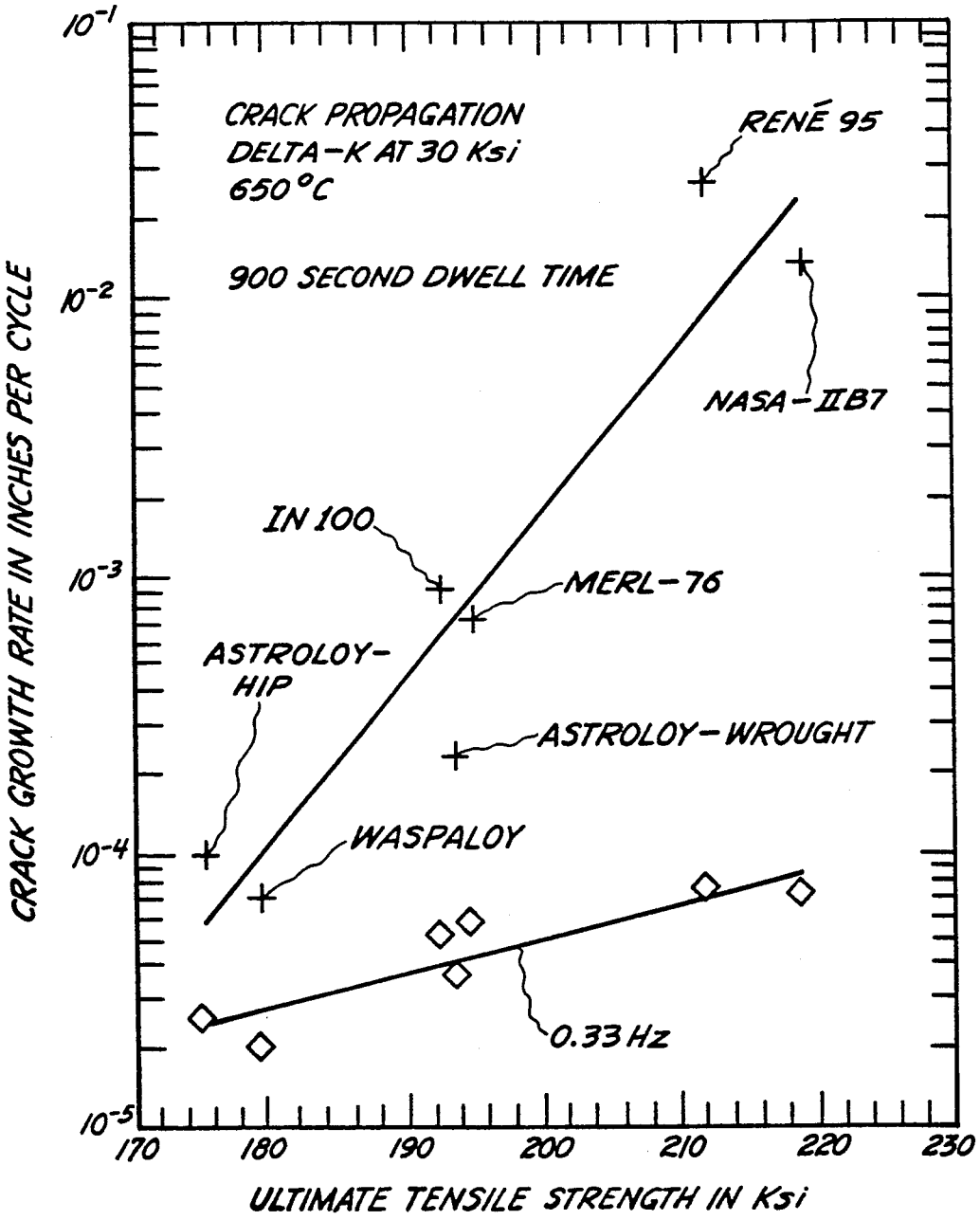
FIG. 1. is a graph in which fatigue crack growth in inches per cycle is plotted on a log scale against ultimate tensile strength in ksi.

I have discovered that by studying the present commercial alloys employed in structures which require high strength at high temperature that the conventional superalloys fall into a pattern. This pattern is based on plotting, in a manner which I have devised, of data appearing in the Final Report NASA CR-165123 referenced above. I plotted the data from the NASA report of 1980 with the parameters arranged as indicated in FIG. 1. There is a generally diagonally aligned array of data points evident from a study of FIG. 1 of the drawings.

In FIG. 1, the crack growth rate in inches per cycle is plotted against the ultimate tensile strength in ksi. The individual alloys are marked on the graph by plus signs which identify the respective crack growth rates in inches per cycle characteristic of the alloy at an ultimate tensile strength in ksi which is correspondingly also characteristics for the labeled alloy. As will be observed, a line identified as a "900 second dwell time plot" shows the characteristic relationship between the crack growth rate and the ultimate tensile strength for these conventional and well known alloys. The data point for the IN-100 alloy, which is a well known commercial alloy, appears in FIG. 1 to the left of the 900 second dwell time line and below the mid-point of the line.

Similar points corresponding to those of the labeled pluses are shown at the bottom of the graph for crack propagation rate tests conducted at 0.33 Hertz or in other words, at a higher frequency. A diamond data point appears in the region along the line labeled 0.33 Hertz for each labeled alloy shown in the upper part of the graph.

From FIG. 1, it became evident that there is no alloy composition, having coordinates which fall in FIG. 1, which had a long dwell time but nevertheless fell in the lower right hand corner of the graph. In fact, since all of the data points for the longer dwell time crack growth testing fell in the region along the diagonal line of the graph, it appeared possible that any alloy composition which was formed to have a high strength at high temperature as required for superalloy use, would fall somewhere along the diagonal line of the graph. In other words, it appeared that it was possible that no alloy composition could be found which had both a high ultimate tensile strength and a low crack growth rate at long dwell times according to the parameters plotted in FIG. 1.

However, I have found that it is possible to produce an alloy which has a composition which permits the unique combination of high ultimate strength and low crack growth rate to be achieved.

Figure 2:
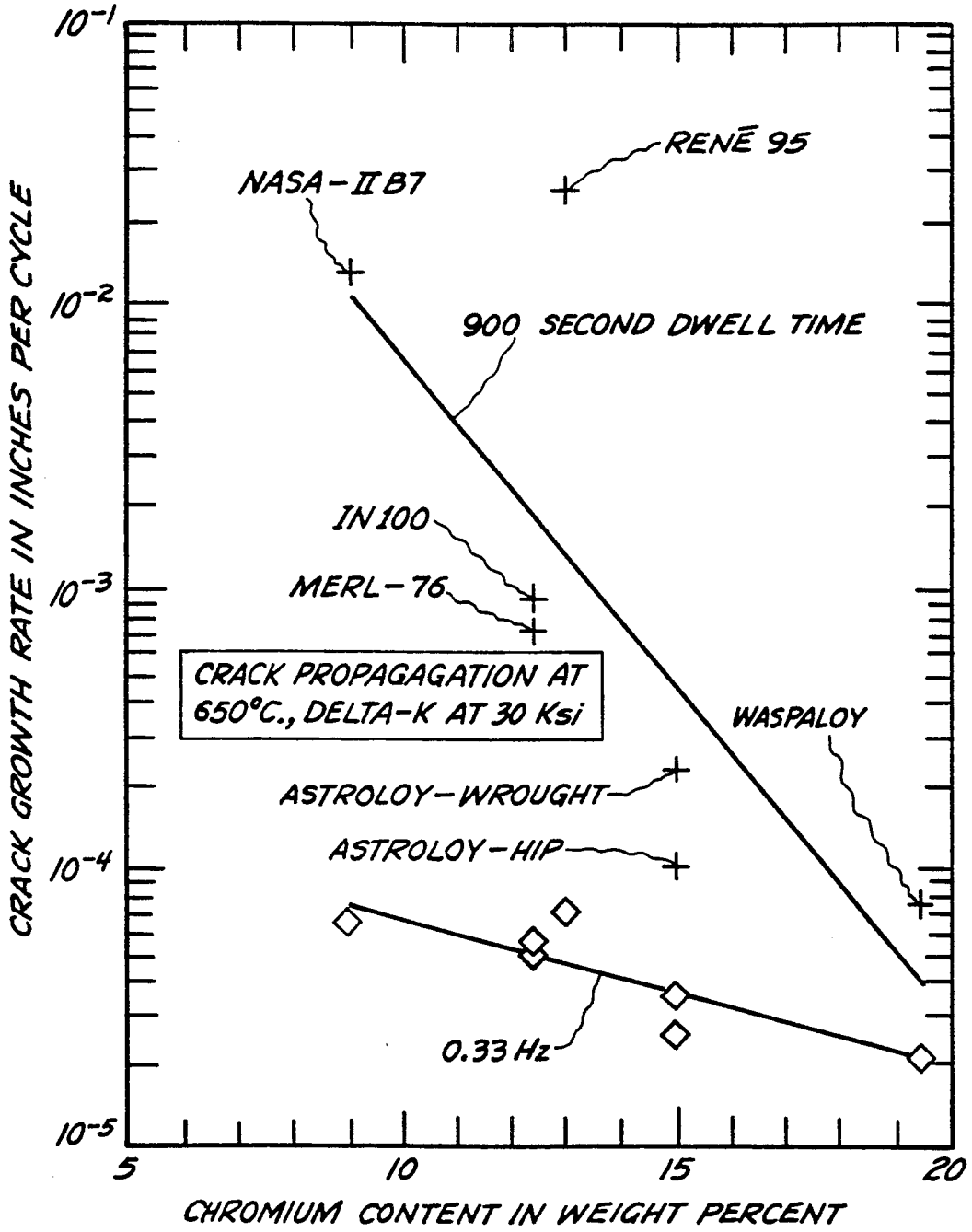
FIG. 2 is a plot similar to that of FIG. 1 but having an abscissa scale of chromium content in weight %.

One of the conclusions which I reached on a tentative basis was that there may be some influence of the chromium concentration on the crack growth rate of the various alloys. For this reason, I plotted the chromium content in weight % against the crack growth rate and the results of this plot is shown in FIG. 2. In this Figure, the chromium content is seen to vary between about 9 to 19% and the corresponding crack growth rate measurements indicate that as the chromium content increases in general, the crack growth rate decreases. Based on this graph, it appeared that it might be very difficult or impossible to devise an alloy composition which had a low chromium content and also had a low crack growth rate at long dwell times.

However, I have found that it is possible through proper alloying of the combined ingredients of a superalloy composition to form a composition similar to an IN-100 alloy in chemistry and in critical properties but which has both a low chromium content and a low crack growth rate at long dwell times.

Figure 3:
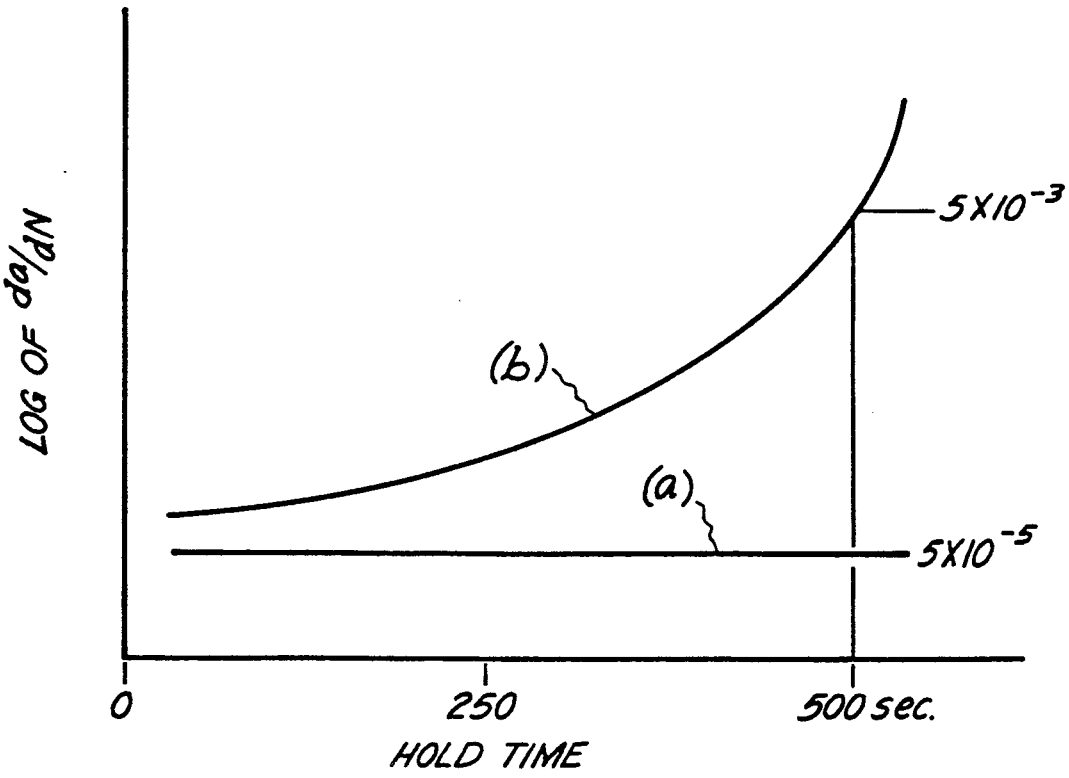
FIG. 3 is a plot of the log of crack growth rate against the hold time in seconds for a cyclic application of stress to a test specimen.

One way in which the relationship between the hold time for subjecting a test specimen to stress and the rate at which crack growth varies, is shown in FIG. 3. In this Figure, the log of the crack growth rate is plotted as the ordinate and the dwell time or hold time in seconds is plotted as the abscissa. A crack growth rate of $5\times10^{-5}$ might be regarded as an ideal rate for cyclic stress intensity factors of 25 ksi$\sqrt{in.}$ If an ideal alloy were formed, the alloy would have this rate for any hold time during which the crack or the specimen is subjected to stress. Such a phenomenon would be represented by the line (a) of FIG. 3 which indicates that the crack growth rate is essentially independent of the hold or dwell time during which the specimen is subjected to stress.

By contrast, a non-ideal crack growth rate, but one which actually conforms more closely to the actual phenomena of cracking, is shown in FIG. 3 by the line plotted as line (b). For very short hold time periods of a second or a few seconds, it is seen that the ideal line (a) and the practical line (b) are separated by a relatively small amount. At these high frequencies or low hold time stressing of the sample, the crack growth rate is relatively low.

However, as the hold time during which stress is applied to a sample is increased, the results which are obtained from experiments for conventional alloys, such as conventional IN-100, follow a line such as (b). Accordingly, it will be seen that there is an increase at greater than a linear rate as the frequency of the stressing is decreased and the hold time for the stressing is increased. At an arbitrarily selected hold time of about 500 seconds, it may be seen from FIG. 3 that a crack growth rate may increase by two orders of magnitude from $5\times10^{-5}$ to $5\times10^{-3}$ above the standard rate of $5\times10^{-5}$.

Again, it would be desirable to have a crack growth rate which is independent of time and this would be represented ideally by the path of the line (a) as the hold time is increased and the frequency of stress application is decreased.

Remarkably, I have found that by making slight changes in the ingredients of IN-100 superalloys it is possible to greatly improve the resistance of the modified alloy to long dwell time crack growth propagation. In other words, it has been found possible to reduce the rate of crack growth by alloying modification of the alloys. Further increase can be obtained as well by the treatment of the alloy. Such treatment is principally a thermal treatment.

EXAMPLE

An alloy identified as HK-48 was prepared. The composition of the alloy was essentially as follows:

| Ingredient | Concentration in weight % |
|---|---|
| Ni | 58.31 |
| Co | 15 |
| Cr | 10 |
| Mo | 3 |
| Al | 3.35 |
| Ti | 5.90 |
| Ta | 2.70 |
| Nb | 1.35 |
| Zr | 0.06 |
| V | 1 |
| C | 0.05 |
| B | 0.03 |

The alloy was subjected to various tests and the results of these tests are plotted in the FIGS. 4 through 9. Herein alloys are identified by an appendage "−SS" if the data that were taken on the alloy were taken on material processed "super-solvus", i.e. the high temperature solid state heat treatment given to the material was at a temperature above which the strengthening precipitate $\gamma'$ dissolves and below the incipient melting point. This usually results in grain size coarsening in the material. The strengthening phase $\gamma'$ which is dissolved during the super-solvus heat treatment re-precipitates on subsequent cooling and aging. Test data identified without the "−SS" appendage were taken on material where all processing after metal powder atomization was below this $\gamma'$ dissolution temperature. Cooling rate has been found to affect alloy properties.

Figures 4A, 4B, 4C:
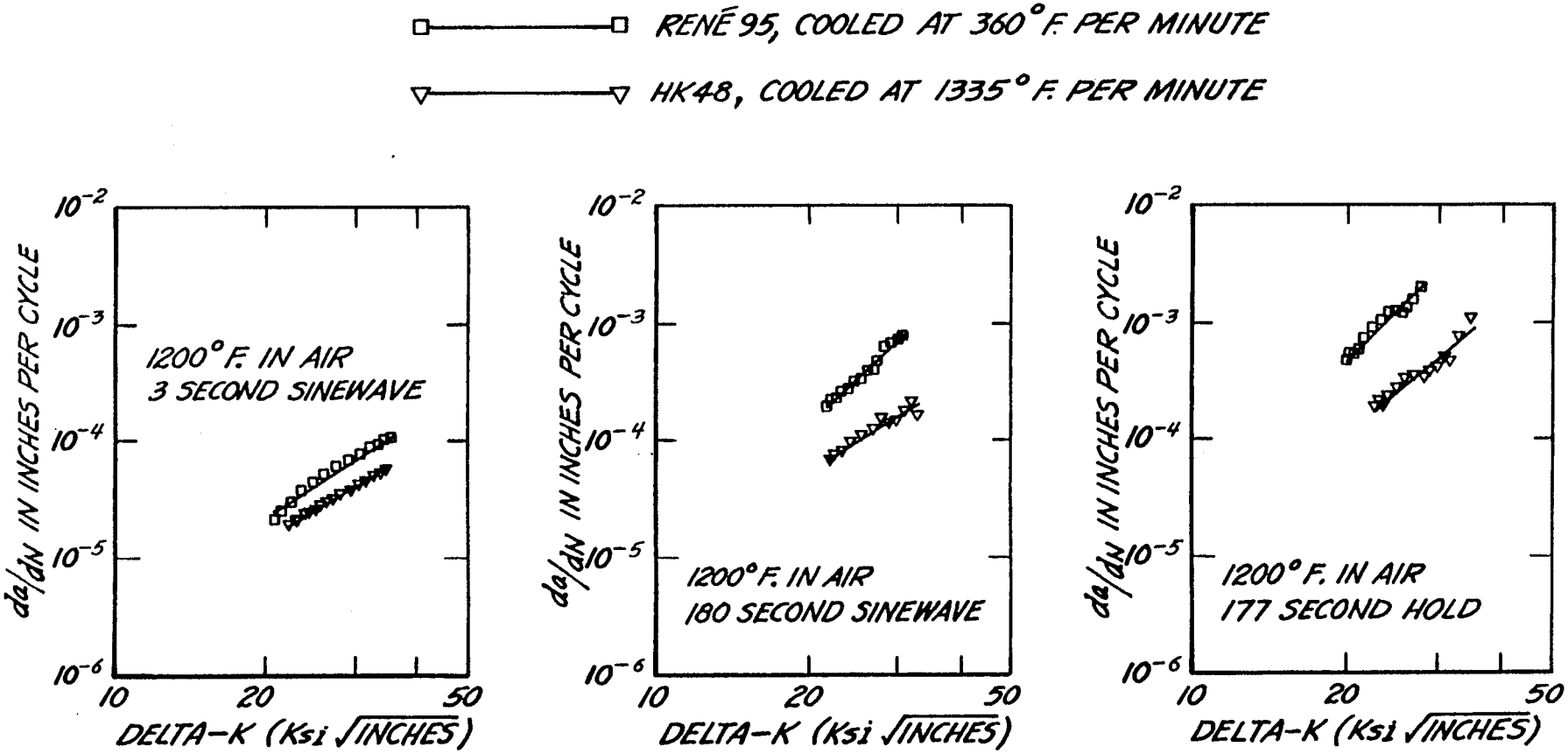
FIGS. 4A, 4B, and 4C are a series of graphs in which fatigue crack growth rate in inches per cycle is plotted on a log scale against the log scale plot of a cyclic stress intensity factor in ksi times the square root of inches. In this series each graph presents data for a different cyclic waveform with a progressively greater hold time as marked. For this series the degree of time dependent fatigue crack growth increases as the hold time increases from the left-most graph to the right-most graph.

Turning now to FIG. 4, data from R'95 and HK-48 processed to the finer grain condition, are shown as crack growth rate plotted against cyclic stress intensity factor at 1200° F. where each sub-plot represents a specific waveform. Shown are a relatively fast continuous cycle (3 second sinewave) "a", a relatively slow continuous cycle (180 second sinewave) "b", and a waveform with a 180 second total period including a 177 second hold at maximum stress intensity factor "c". These three waveforms represent an increasing degree of time dependent fatigue crack propagation respectively. It is evident that the HK-48 is superior over a broad range of cyclic stress intensity factor for all three waveforms. Note that available data for this format of comparison required contrasting HK-48 cooled at 1335° F./min to R'95 cooled at 360° F./min. Examination of the trends seen in the teachings of copending application Ser. No. 250205, filed Sept. 28, 1988, show that the comparison would show an even larger advantage for HK-48 if data were available at the same cooling rate for each alloy.

Figures 5A, 5B, 5C:
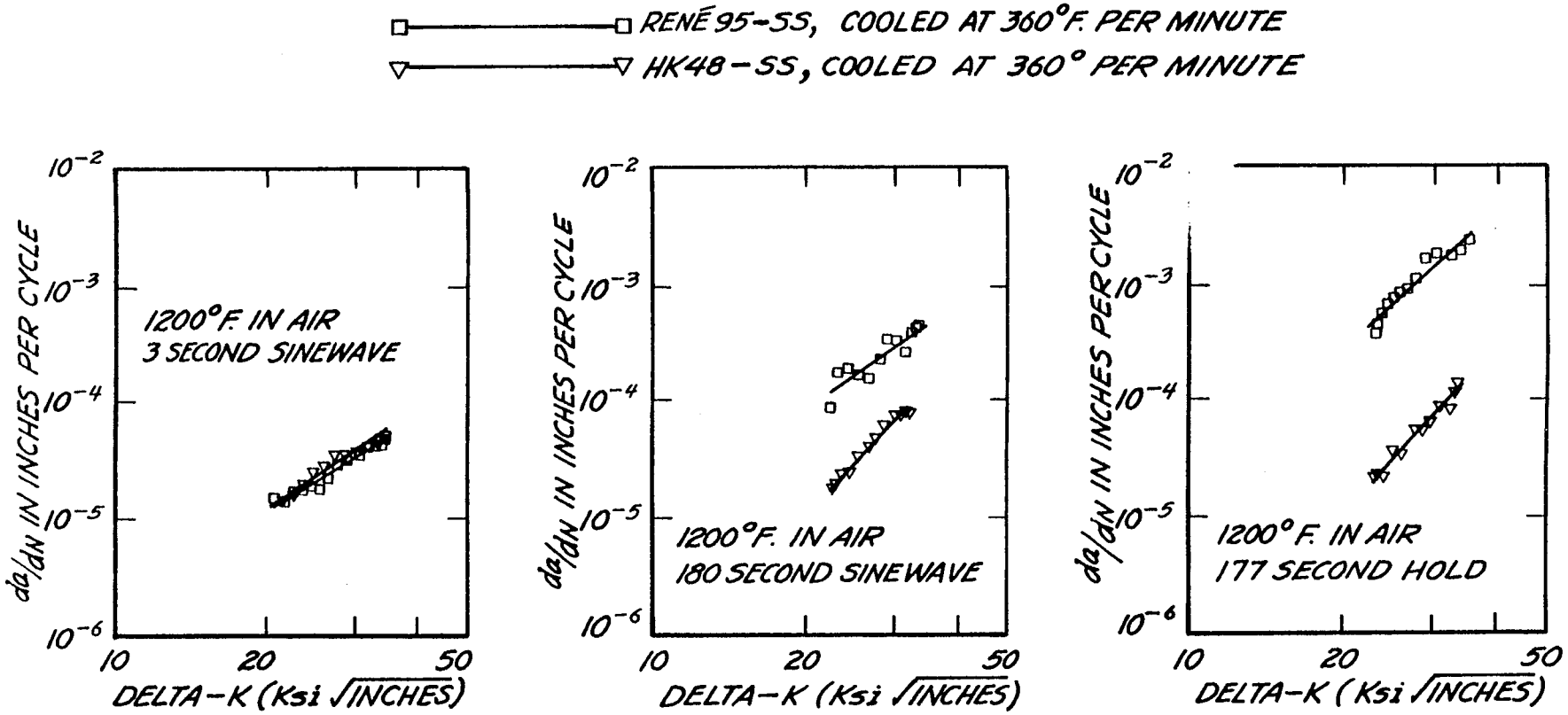
FIGS. 5A, 5B, and 5C are a series of graphs in which fatigue crack growth rate in inches per cycle is plotted on a log scale against the log scale plot of a cyclic stress intensity factor in ksi times the square root of inches and in which each graph represents a different cyclic waveform as designated thereon such that the degree of time dependent fatigue crack growth increases as the series progress from the left-most graph to the right-most graph.

Turning now to FIG. 5, the same format of comparison is used as was used with reference to FIG. 4. The data of FIG. 5 is shown for the two alloys R'95-SS and HK-48-SS processed to the larger grain condition. For the larger grain condition data were available for the same cooling rate, 360° F./min.

FIGS. 4 and 5 demonstrate that HK-48 is remarkably more resistant to time dependent fatigue crack propagation over a wide range of cyclic periods and hold times, a wide range of cooling rates, a wide range of cyclic stress intensity factors, and a wide range of grain sizes.

Figure 6:
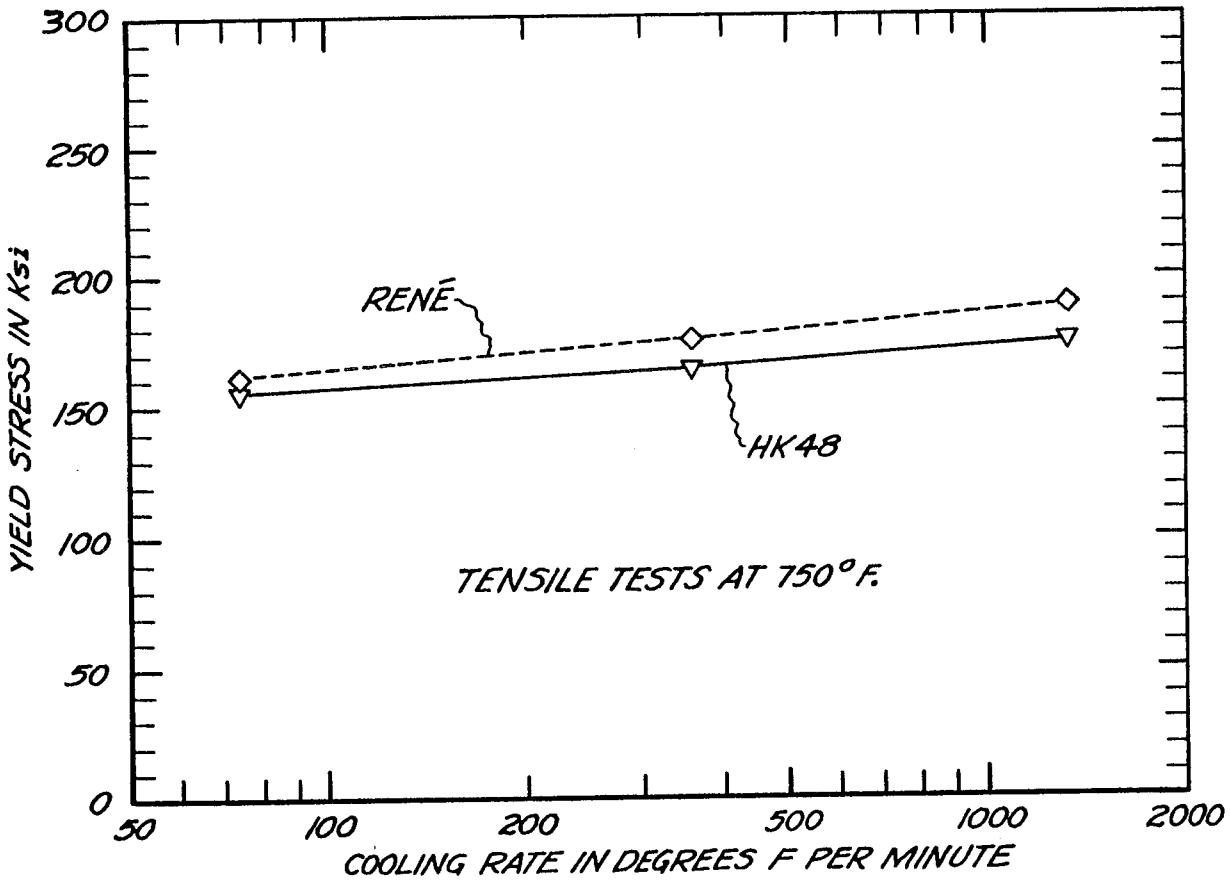
FIG. 6 is a graph in which yield stress in ksi is plotted against cooling rate in degrees Fahrenheit on a log scale.
Figure 7:
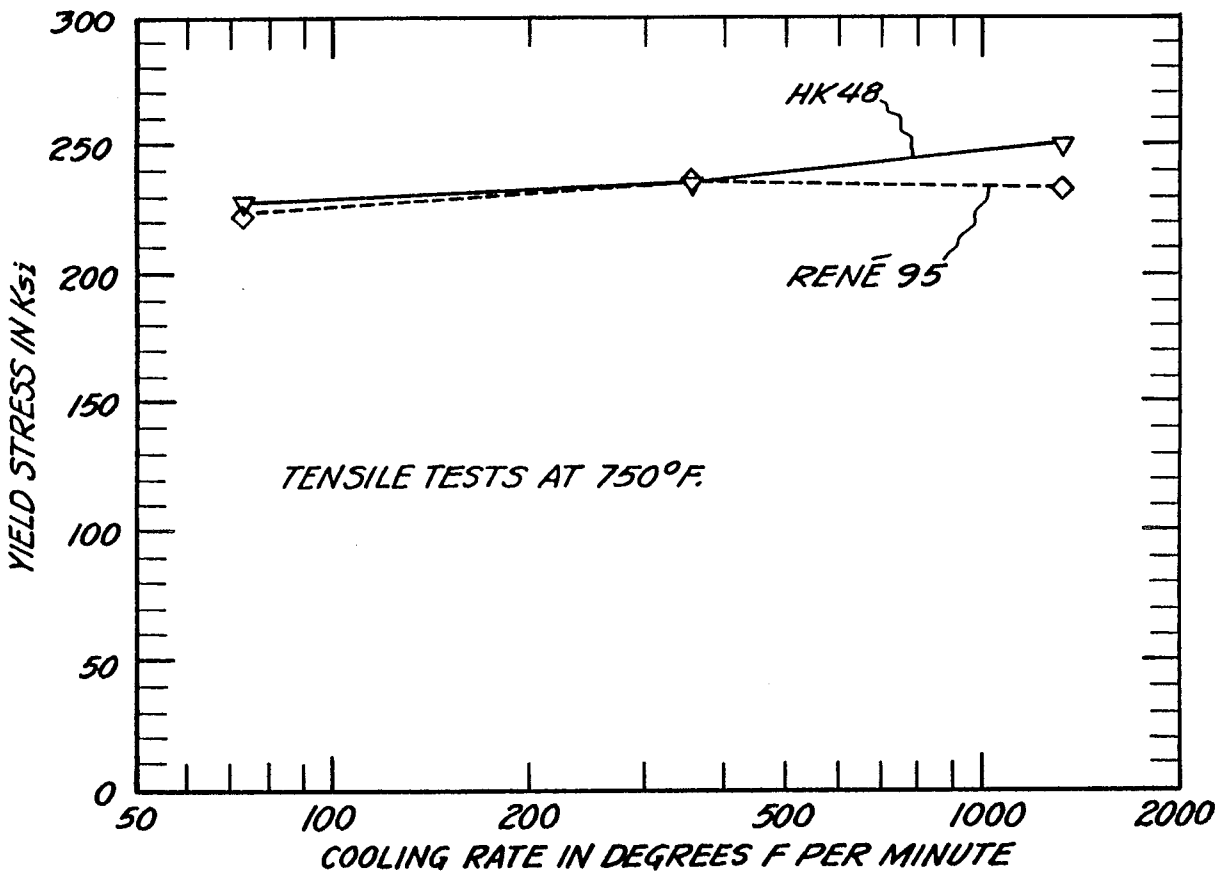
FIG. 7 is a graph in which ultimate tensile strength in ksi is plotted against cooling rate in degrees Fahrenheit on a log scale.

Turning now to FIGS. 6 and 7, the tensile yield stress and ultimate tensile strength at 750° F. are plotted against cooling rate for material processed to the finer grain conditions for the two test materials R'95 and HK-48. FIG. 7 demonstrates that HK-48-SS manifests an increasingly larger advantage over R'95-SS as the degree of time dependence in crack growth rate increases. The alloy HK-48 is seen to be only 4 to 8% lower than R'95 in yield stress depending on cooling rate and to be equivalent to R'95 to 7% higher in ultimate tensile strength.

Figure 8:
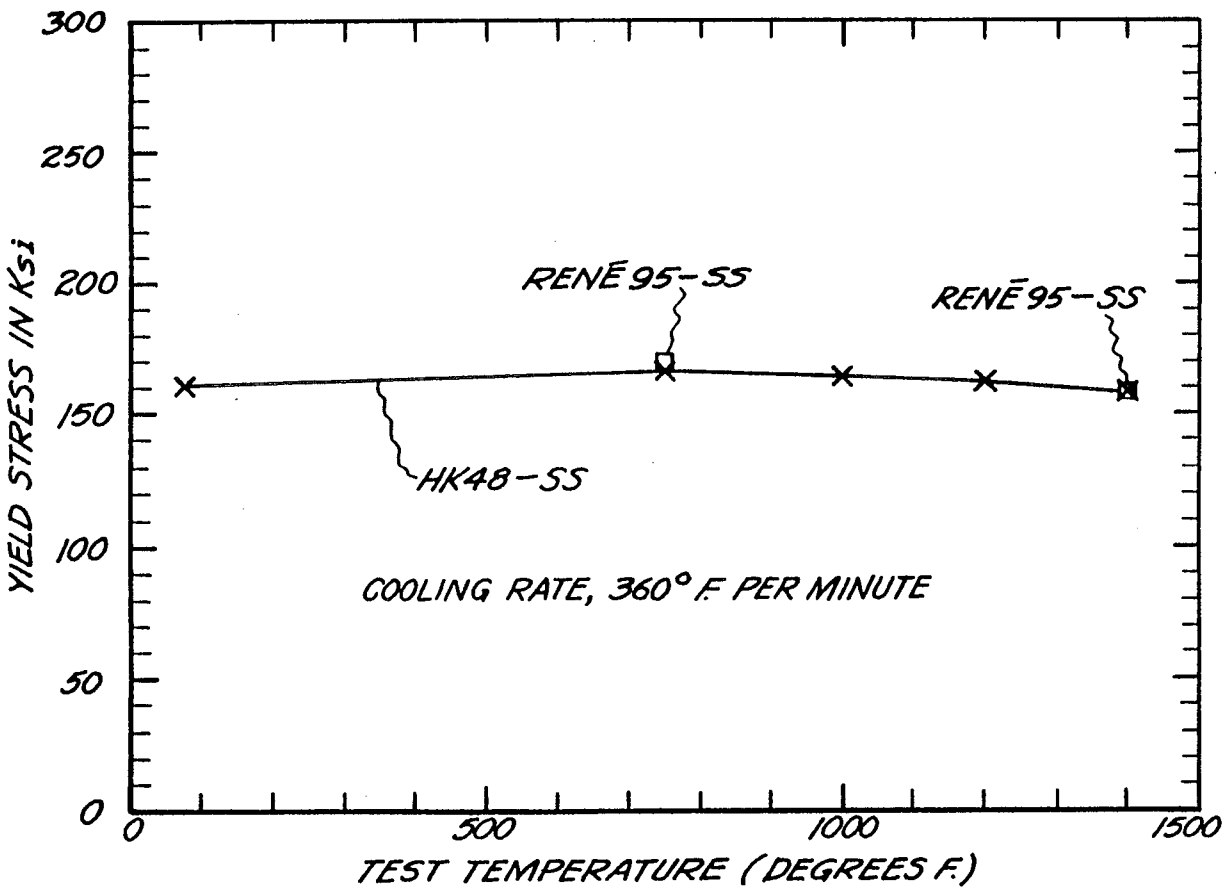
FIG. 8 is a graph in which yield stress in ksi is plotted against test temperature.
Figure 9:
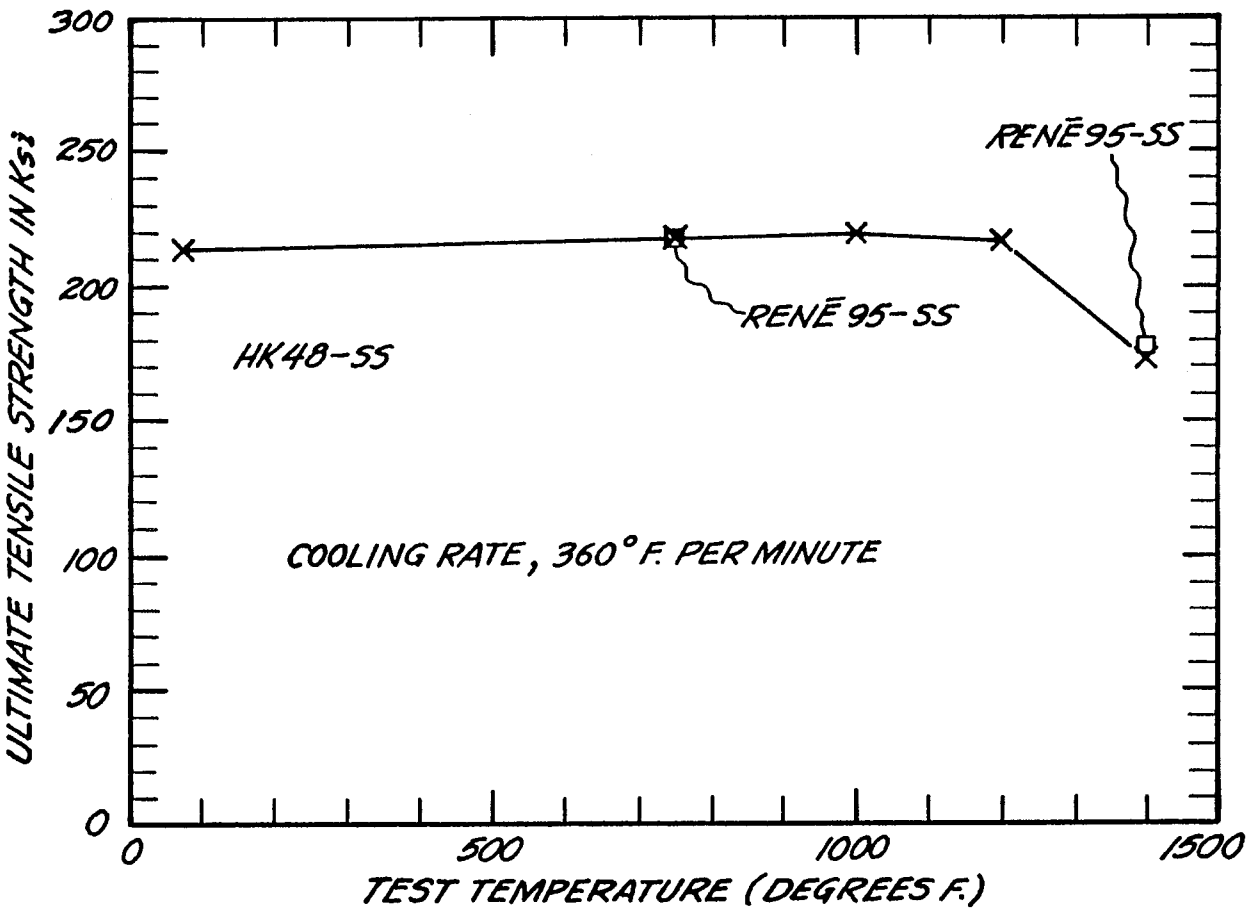
FIG. 9 is a graph in which ultimate tensile strength in ksi is plotted against test temperature.

Turning now to FIGS. 8 and 9, the tensile yield stress and ultimate tensile stress are plotted against tensile test temperature for material processed to the larger grain condition, R'95-SS and HK-48-SS, and cooled at a fixed cooling rate, 360° F./min. HK-48-SS is seen to be essentially equivalent to R'95-SS in resistance to tensile deformation over a broad range of test temperatures.

From FIGS. 4 through 9, it is seen that HK-48, processed to the finer or the larger grain condition, results in a remarkable combination of resistance to tensile deformation and resistance to time dependent fatigue crack propagation, and that the combination is unexpected from the prior art. This is quite surprising inasmuch as the constituents of the subject alloy are only slightly different from constituents found in IN-100 alloy although the slight difference is critically important in yielding dramatic differences, and specifically reductions, in crack propagation rates at long cycle fatigue tests. It is this slight difference in ingredients and proportions which results in the surprising and unexpectedly low fatigue crack propagation rates coupled with a highly desirable set of strength and other properties as also evidenced from the graphs of the Figures of the subject application.

Moreover, with respect to inhibition of fatigue crack propagation the subject alloy is far superior to other alloys prepared at cooling rates of 100° F./min to 600° F./min which are the rates which are to be used for industrial production of the subject alloy.

What is remarkable about the achievement of the present invention is the striking improvement which has been made in fatigue crack propagation resistance with a relatively small change in ingredients of the HK-48 alloy as compared to those of the IN-100 alloy.

To illustrate the small change in alloy compositions, the ingredients of both the IN-100 and the HK-48 are listed here.

TABLE I

| Ingredient | HK48 | IN-100 |
|---|---|---|
| Ni | 57.56 | 60.55 |
| Co | 15 | 15 |
| Cr | 10 | 10 |
| Mo | 3 | 3 |
| W | — | — |
| Al | 3.35 | 5.5 |
| Ti | 5.90 | 4.7 |
| Ta | 2.70 | — |
| Nb | 1.35 | — |
| Hf | — | — |
| Zr | 0.06 | 0.06 |
| V | 1 | 1 |
| Re | — | — |
| C | 0.05 | 0.18 |
| B | 0.03 | 0.01 |
| Fe | — | — |

From the above Table I, it is evident that the only significant difference between the composition of alloy IN-100 as compared to that of alloy HK-48 is that the IN-100 contains a slightly higher concentration of aluminum, lower concentration of titanium, and contains no tantalum or niobium whereas the HK-48 contains only about 1.2 weight percent more titanium and 2.15 weight percent less aluminum as IN-100 but the HK-48 does contain tantalum and niobium in significant amounts.

In other words, the IN-100 composition is altered by adding the 1.2 weight percent of titanium and omitting 2.15 weight percent of aluminum and including 2.70 weight % of tantalum and 1.35 weight % of niobium. It is deemed rather remarkable that this alteration of the composition can accomplish a preservation or improvement of the basic strength properties of IN-100 alloy and at the same time greatly improve the long dwell time fatigue crack inhibition of the alloy. However, this is precisely the result of the alteration of the composition as is evidenced by the data which is given in the figures and discussed extensively above.

The alteration of the titanium, aluminum, tantalum and niobium additives are responsible for the remarkable changes in the inhibition of the fatigue crack propagation.

Other changes in ingredients may be made which do not cause such remarkable change of properties, particularly smaller changes of some ingredients. For example, small additions of rhenium may be made to the extent that they do not change, and particularly do not detract from, the uniquely beneficial combination of properties which have been found for the HK-48 alloy.

While the alloy is described above in terms of the ingredients and percentages of ingredients which yield uniquely advantageous proportions, particularly with respect to inhibition of crack propagation it will be realized that other ingredients such as yttrium, vanadium, etc., can be included in the composition in percentages which do not interfere with the novel crack propagation inhibition. A small percentage of yttrium between 0 and 0.1 percent may be included in the subject alloy without detracting from the unique and valuable combination of properties of the subject alloy.

What is claimed is:

1. As a composition of matter an alloy consisting essentially of the following ingredient in the following proportions:

| Ingredient | Concentration in weight % Claimed Composition | |
|---|---|---|
| | From | To |
| Ni | balance | |
| Co | 12 | 18 |
| Cr | 7 | 13 |
| Mo | 2 | 4 |
| W | 0 | 1.0 |
| Al | 2.0 | 5.0 |
| Ti | 5.0 | 7.0 |
| Ta | 2.0 | 3.2 |
| Nb | 1.0 | 1.7 |
| Hf | 0 | 0.75 |
| Zr | 0 | 0.1 |
| V | 0.0 | 2.0 |
| C | 0.0 | 0.2 |
| B | 0.0 | 0.10 |
| Re | 0 | 1 |
| Y | 0 | 0.1 |

said composition having been cooled at a rate of approximately 600° F. per minute or less.

2. The composition of claim 1, which has been cooled at a rate between 50° and 600° F. per minute.

3. As a composition of matter an alloy consisting essentially of the following ingredient in the following proportions:

| Ingredient | Concentration in Weight % Claimed Composition |
|---|---|
| Ni | balance |
| Co | 15 |
| Cr | 10 |
| Mo | 3 |
| Al | 3.35 |
| Ti | 5.90 |
| Ta | 2.70 |
| Nb | 1.35 |
| Zr | 0.06 |
| V | 1 |
| C | 0.05 |
| B | 0.03 |

said composition having been cooled at a rate of approximately 600° F. per minute or less.

4. The composition of claim 3, which has been cooled at a rate between 50° and 600° F. per minute.

* * * * *